US009017137B2

(12) United States Patent
Boser

(10) Patent No.: US 9,017,137 B2
(45) **Date of Patent: *Apr. 28, 2015**

(54) PRE-ENCASED UNDERWIRE ASSEMBLY

(71) Applicant: Apparel Machinery Services, Inc., Port St. Lucie, FL (US)

(72) Inventor: Ronald Boser, Port St. Lucie, FL (US)

(73) Assignee: Apparel Machinery Services, Inc., Port St. Lucie, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/199,067

(22) Filed: Mar. 6, 2014

(65) Prior Publication Data

US 2014/0187120 A1 Jul. 3, 2014

Related U.S. Application Data

(63) Continuation of application No. 13/855,177, filed on Apr. 2, 2013, now Pat. No. 8,702,470, which is a continuation of application No. 12/850,173, filed on Aug. 4, 2010, now Pat. No. 8,430,715.

(60) Provisional application No. 61/232,118, filed on Aug. 7, 2009.

(51) Int. Cl.

| | |
|---|---|
| ***A41C 3/00*** | (2006.01) |
| ***A41C 5/00*** | (2006.01) |
| ***A41C 3/12*** | (2006.01) |

(52) U.S. Cl.

CPC . *A41C 5/00* (2013.01); *A41C 3/122* (2013.01); *A41C 3/126* (2013.01)

(58) Field of Classification Search

CPC ..... A41C 1/12; A41C 1/14; A41C 1/16; A41C 3/0007; A41C 3/0014; A41C 3/0021; A41C 3/0028; A41C 3/0035; A41C 3/12; A41C 3/122

USPC ..... 450/41, 49, 51, 52, 47

See application file for complete search history.

(56) References Cited

U.S. PATENT DOCUMENTS

| | | | | |
|---|---|---|---|---|
| 4,203,449 | A | 5/1980 | Winzelberg | |
| 5,215,494 | A * | 6/1993 | Flanagan | 450/61 |
| 6,071,578 | A | 6/2000 | Richardson et al. | |
| 6,682,395 | B2 | 1/2004 | Falla et al. | |
| 6,896,580 | B2 | 5/2005 | Falla et al. | |
| 7,207,861 | B2 * | 4/2007 | Martini | 450/49 |

* cited by examiner

*Primary Examiner* — Gloria Hale

(74) *Attorney, Agent, or Firm* — Lerner, David, Littenberg, Krumholz & Mentlik, LLP

(57) ABSTRACT

Disclosed herein are encased underwire assemblies and methods of manufacturing such assemblies for attachment to an article of clothing. An encased underwire assembly may comprise an underwire having an inner radius, an outer radius, a first end and a second end, and a fabric enclosure having a first fastened side adjacent the inner radius, a first sealed end adjacent the first end, and a second sealed end adjacent the second end of the underwire. In a method of manufacturing such assembly, a fabric enclosure may be created by bringing together opposite side edges of a fabric layer and fastening the opposite side edges to one another, inserting an underwire into a first open end of the fabric enclosure until a first end and a second end of the underwire are housed within the fabric enclosure, and sealing the first open end and a second open end of the fabric enclosure.

18 Claims, 10 Drawing Sheets

PRE-ENCASED UNDERWIRE ASSEMBLY

CROSS-REFERENCE TO RELATED APPLICATIONS

The present application is a continuation of U.S. patent application Ser. No. 13/855,177, filed Apr. 2, 2013, which is a continuation of U.S. patent application Ser. No. 12/850,173, filed Aug. 4, 2010, now U.S. Pat. No. 8,430,715, which claims the benefit of the filing date of U.S. Provisional Patent Application No. 61/232,118, filed Aug. 7, 2009, the disclosures of which are hereby incorporated herein by reference.

FIELD OF THE TECHNOLOGY

The present invention generally relates to methods for encasing underwires for brassieres and manufacturing brassieres with such encased underwires. The improved methods for encasing such underwires minimizes the manufacturing time required to encase underwires, minimizes the time to manufacture brassieres made with such encased underwires, and minimizes the likelihood that such an underwire will poke through the encasing material.

BACKGROUND OF THE INVENTION

The use of underwires in brassieres is well known in the prior art. Common complaints from wearers of underwire brassieres include poor fit, pinching due to the interaction of the underwire and fabric components of the brassiere, and the need to dispose of such a brassiere because the underwire has poked through the fabric encasing the underwire. It is an objective of the present invention to provide an improved brassiere that overcomes the foregoing and other shortcomings of the prior art.

A need exists for improvement in the field of brassieres that incorporate underwires and the methods for encasing such underwires and manufacturing brassieres using such underwires. This and other needs are addressed by one or more aspects of the present invention.

There are numerous methods for encasing underwires, and numerous methods for affixing such encased underwires to brassiere cups and/or the fabric belt of the brassiere. Regardless of the methods used, there is a tendency for the ends of the underwire to poke through the encasing fabric and for the underwire to break the stitching that keeps the underwire encased. While the cups and belt of such a brassiere may remain in wearable condition, the damage caused by the underwire often causes the wearer to discard the brassiere prematurely.

Typical prior art underwires are sewn into a brassiere after the remainder of the brassiere is assembled. That is, the fabric belt is typically assembled first, the cups (if separate) are sewn in next, and then a sandwich comprising a layer of lining fabric, an underwire, and a backing fabric are sewn to the fabric belt. The sewing starts with a bar-tack at the top (shoulder strap attachment point) of the belt, and then the sandwich is stitched to the bottom of the belt and a cup using a double needle sewing machine. The stitching proceeds towards the center of the belt.

The above sewing means results in several points where the finished garment is fairly thick due to the number of fabric components and the number of stitching operations. This can create bulges and inflexible fabric bunching, which can be unsightly and uncomfortable for the wearer. It is therefore an objective of the present invention to minimize the number of sewing operations to minimize cost, reduce fabric waste, and allow for the manufacture of brassieres that are more attractive and more comfortable. Prior art underwires are also prone to poke through the fabric encasement due to the interaction of the underwire, its encasing fabric, and the related stitching, as the wearer's breasts move during normal motion. Such movement can cause the underwire to abrade the encasing fabric and stitching, eventually causing the encasement to fail and the underwire to poke through. The uncovered end of the underwire can be very uncomfortable for the wearer and can create unsightly bulges under the wearer's clothing. The result is that the wearer typically will discard an otherwise useable brassiere. The encased underwire of the present invention is encased in a fabric enclosure or tube, said tube being closed longitudinally with a single stitched edge, prior to assembly with the remaining components of a brassiere.

An objective of the present invention is to provide an underwire that is fully encased in a fabric enclosure as a separate assembly. The encased underwire of the present invention may have a fabric extension or tab at each end that can be easily sewn in to the top or center of a brassiere belt. It is a further objective of the present invention to provide an encased underwire that is sealed at each end, thereby eliminating the need to bar-tack the ends to the belt of a brassiere belt.

It is a further objective of the present invention to provide an encased underwire that can be sewn into the belt of a brassiere starting from the center and ending at the back.

SUMMARY OF THE INVENTION

The underwire of the present invention accomplishes the above objectives as described below.

A first aspect of the present invention is a method of manufacturing an underwire assembly for attachment to other components of a brassiere, the underwire assembly including a fabric layer and an underwire. The method comprises creating a fabric enclosure having a sealed side and first and second open ends by bringing together opposite side ends of the fabric layer and fastening the opposite side ends to one another substantially along a length thereof. The method further comprises inserting the underwire into the first open end of the fabric enclosure and continuing to pass the underwire through the fabric enclosure until a first end and a second end of the underwire are completely housed within the fabric enclosure. The method further comprises sealing the first and second open ends of the fabric enclosure such that the underwire is encased within the sealed side and first and second sealed ends of the fabric enclosure.

In one embodiment of the first aspect of the present invention, the opposite side ends of the fabric layer are fastened together by stitching. In another embodiment of the first aspect of the present invention the opposite side ends of the fabric layer are fastened together by adhesive. In yet another embodiment of the first aspect of the present invention the opposite side ends of the fabric layer are fastened together by ultrasonic welding.

In one embodiment of the first aspect of the present invention sealing the first and second open ends of the fabric enclosure creates first and second extension ends extending outwardly from the first and second sealed ends of the fabric enclosure respectively. The method further includes attaching the first extension end to a second portion of the brassiere and the second extension end to a third portion of the brassiere to further secure the underwire assembly to the brassiere.

In another embodiment of the first aspect of the present invention includes attaching a side of the fabric enclosure opposite the sealed side substantially along a length of the side to a first portion of the brassiere in order to secure the fabric enclosure to the brassiere with the sealed side facing away from the side being attached to the brassiere.

In yet another embodiment of the first aspect of the present invention, sealing the first and second open ends of the fabric enclosure seals the inner fabric layer substantially around the first and second ends of the underwire.

In still yet another embodiment of the first aspect of the present invention, sealing the first open end of the fabric enclosure creates a first space between the first end of the underwire and the sealed first end of the fabric enclosure and a second space between the second end of the underwire and the sealed second end of the fabric enclosure.

In one embodiment of a second aspect of the present invention, an underwire is encased in a fabric enclosure or tube. The fabric tube may be formed by laminating a lining layer, such as a layer of polyester tricot, to a second fabric layer made of any suitable material. The two fabric layers may be laminated by an adhesive, by a film, or by other means. The laminated fabric is preferably wrapped around the underwire with the lining layer facing the underwire, and the second layer facing outwards. The tube is then closed longitudinally about the underwire by stitching the edges by conventional means. The ends of the tube are then closed by sealing each end along a sealing area. A small gap may be left between the ends of the underwire and the sealing area to account for longitudinal shrinkage of the fabric tube. The ends may be sealed by an adhesive, by ultrasonic welding, by RF welding, or other similar means. Sealing the ends in this manner ensures that the sealed ends are smoother due to the low profile as compared to a prior art underwire that uses a folded fabric and a bar-tack sewing stitch. An extension or tab of fabric is preferably left at each end of the assembled encased underwire. The tabs are then used to further secure the underwire assembly to the brassiere belt. The underwire of the present invention may be sewn into the brassiere belt prior to completion of the sewing steps that create the top and back of the belt. The fabric tabs of the encased underwire can therefore be easily hidden under the top and back trim tapes of the brassiere belt during the sewing steps that are employed to complete the assembly of the belt.

BRIEF DESCRIPTION OF THE DRAWINGS

One or more preferred embodiments of the present invention will now be described in detail with reference to the accompanying drawings, wherein the same elements are referred to with the same reference numerals.

DETAILED DESCRIPTION

Figure 1:
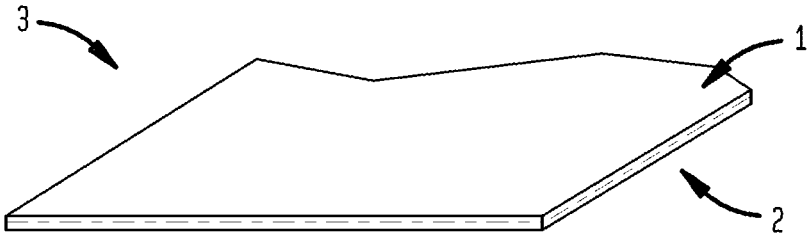
FIG. 1 is a perspective view showing an inner fabric layer laminated to an outer fabric layer for use with the present invention.

As a preliminary matter, it will readily be understood by one having ordinary skill in the relevant art (an "Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended to, nor is to be construed to, limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Referring now to the drawings, one or more embodiments of the present invention are described. The following description of one or more embodiments is merely exemplary in nature and is in no way intended to limit the invention, its implementations, or uses.

FIG. 1 shows a laminated fabric 3 comprising an inner or lining layer 1 laminated by some means to an outer layer 2. Lining layer 1 is typically made from a tricot material or other suitable lining, and allows the underwire to move against the lining without snagging the outer fabric layer 2. The outer fabric layer 2 can be made from any number of common fabric materials, whether woven or non-woven.

Figure 2:
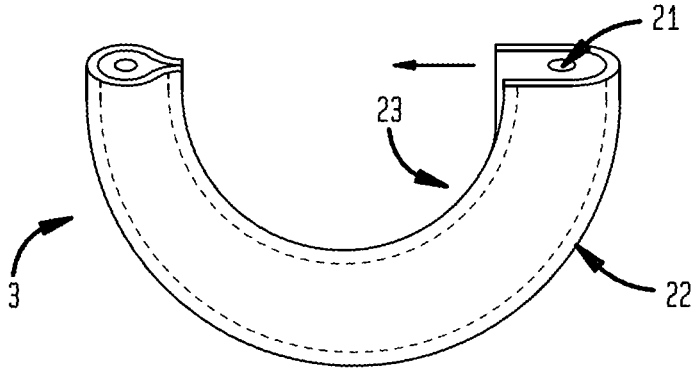
FIG. 2 is a front view of a prior art encased underwire.

FIG. 2 is a front view of a prior art encased underwire. The underwire 21 is shown partially encased by a laminated fabric 3. The laminated fabric 3 is shown positioned around the underwire 21 as a tube of fabric with the edges 23 facing towards the inner radius of the underwire 21 and the folded (or middle) edge 22 of the fabric facing towards the inner radius of the underwire 21. The edges 23 are affixed to each other by means of conventional stitching using a sewing machine.

When a brassiere incorporating such a prior art encased underwire 21 is worn, the weight of the wearer's breast generally applies pressure to the interface between the underwire 21 and the stitched edge 23 of the fabric. This pressure may cause abrasion between the underwire 21 and the stitching as the underwire moves with the movement of the wearer's breast and can cause the stitching to abrade and fail.

Figure 3:
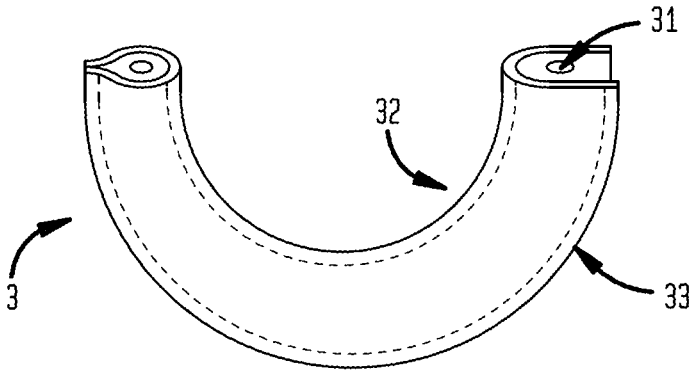
FIG. 3 is a front view of one embodiment of an underwire encased in a fabric enclosure of the present invention.

FIG. 3 is a front view of one embodiment of an underwire encased in a fabric enclosure of the present invention. The underwire 31 is shown partially encased by a laminated fabric 3. The laminated fabric 3 is shown positioned around the underwire 31 as an enclosure or tube of fabric with the edges 33 facing towards the outer radius of the underwire 31 and the folded (or middle) edge 32 of the fabric facing towards the inner radius of the underwire 31. The edges 33 can be affixed to each other by means of conventional stitching using a sewing machine or some other sealing method such as ultrasonic sealing, radio-frequency (RF) sealing, adhesive, or other common means.

When a brassiere incorporating the underwire 31 of the present invention is worn, the weight of the wearer's breast generally applies pressure to the interface between the underwire 31 and the folded edge 32 of the fabric. Since there are no stitches at this interface, in contrast to the prior art underwire encasement described in FIG. 2, wear is minimized and the underwire 31 cannot cause the stitching to abrade and fail.

Figure 4:
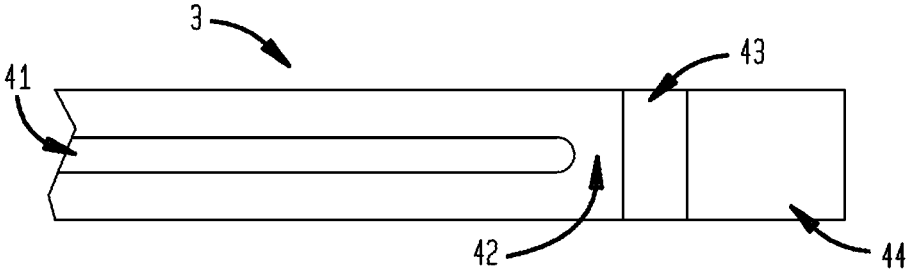
FIG. 4 is a cutaway view of one end of an encased underwire of the present invention.

FIG. 4 is a cutaway view of one end of an encased underwire of the present invention. The underwire 41 is shown as a fabric enclosure or tube 3. The sealing area 43 is the portion of the fabric tube that closes off an end of the tube. The means for sealing this sealed end 43 can be ultrasonic welding, RF welding, or adhesive sealing, or other non-sewing means. Sealing area 43 can be a straight-sealed seam, or can be u-shaped to conform to the shape of the end of underwire 41. A distance 42 can be selected to account for shrinkage of the encasing fabric tube 3, and can be accurately chosen due to the precision of the sealing means employed in the present invention.

A conventionally encased underwire, such as underwire 21, is generally sewn into the encasing fabric during the sewing of the brassiere. The top and back of the brassiere belt are generally completed before the cups and underwires are attached. The end of the encased underwire 21 is typically bar-tacked to the top of the brassiere belt (the top being the attach point for the shoulder strap in the front of the brassiere) and one cup, the underwire is positioned in the fabric tube 3, and the fabric tube is sewn shut along edges 23 and to a brassiere cup and to the brassiere belt at the same time. This is generally a difficult sewing operation and requires a skilled sewing machine operator to perform. The sewing is made more difficult towards the center of the belt as the two underwires and the cups are in close proximity at this point in the sewing operation, and further limits the types of brassieres that can be sewn on a particular sewing machine. Once the tube is completely sewn along the edges 23, the end of the tube is bar-tacked to affix the end of the underwire 21 to the brassiere belt and a cup, and to prevent the underwire from being displaced from the fabric tube during use or laundering. The end of the fabric tube is preferably then cut away as scrap, and a finish tape may be applied to cover the cut end. Due to the number of fabric layers and stitching layers at the top edge (the tube bar-tack and the finish tape), the finished garment may be somewhat thick. This can create lumps in the garment and also be uncomfortable for the wearer.

The encased underwire 31 of the present invention may be encased prior to the assembly of the underwire and the brassiere cups and belt. A fabric tube of great length may be formed by stitching the edges 33 of fabric 3. In one embodiment, a fabric tab 44 of a given length can be measured, a first end of the fabric tube can be sealed along a sealing area 42, and the finished length (accounting for a sealing area 42 and tab 44 at the second end) can be measured and cut. An underwire 41 can be inserted into the tube, and the second end can then be sealed. In another embodiment, a first end of an underwire can be inserted into a first open end of a fabric enclosure until the first end and a second end of the underwire is completely housed within the fabric enclosure. First and second open ends of the fabric enclosure may then be sealed, creating first and second sealed ends. The finished encased underwire assembly can then be attached to the brassiere belt and a cup in a single operation. Since the underwire 41 is pre-encased in an assembly, it can be sewn to the brassiere belt and a cup by starting from the center of the belt and sewing towards the back of the brassiere belt. This is an easier sewing operation and can be performed more quickly than with a prior art underwire. This also minimizes fabric waste, allows for a lower profile stitch, and maximizes sewing efficiency for lower sewing cost.

Figure 5:
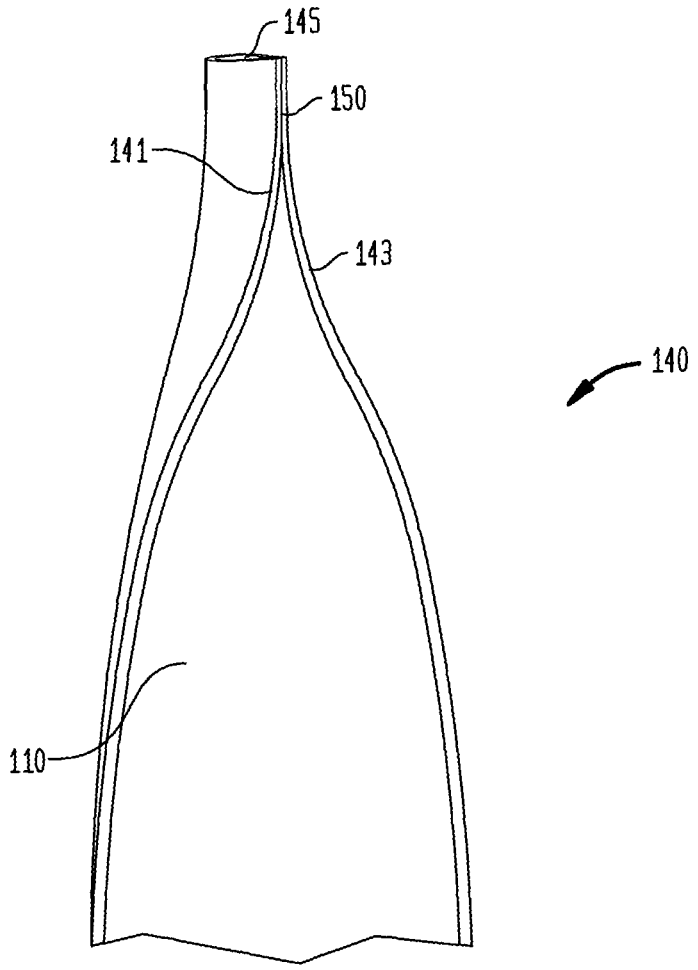
FIG. 5 is a perspective view of a partially formed fabric enclosure showing the beginning of a sealed side of the fabric enclosure.
Figure 6:
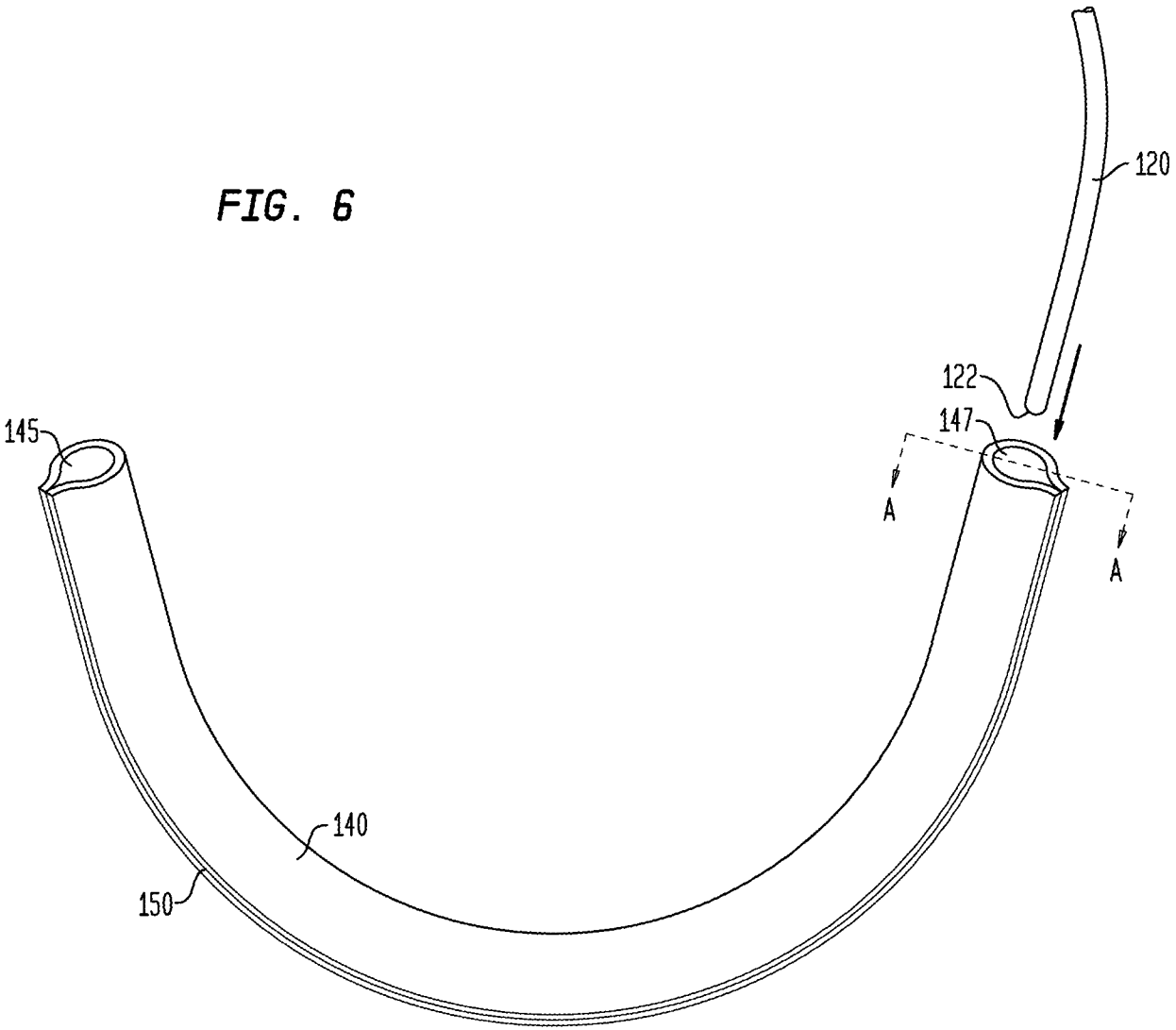
FIG. 6 is a perspective view of an underwire just before being received by an open end of a fabric enclosure.
Figure 7:
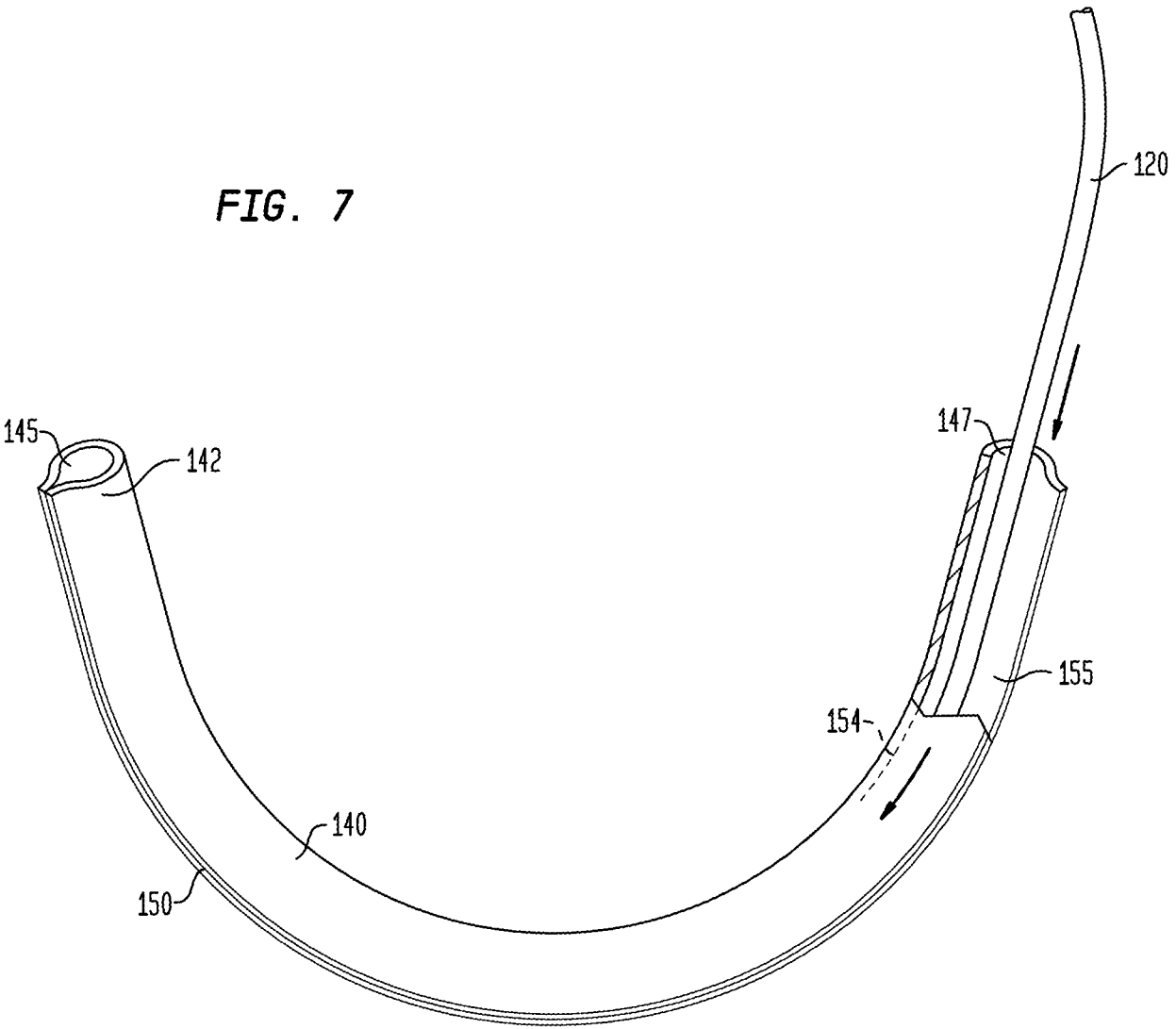
FIG. 7 is a partial cross-sectional view taken along line A-A shown in FIG. 6 of an underwire having passed through a first open end of a fabric enclosure and partially contained within the fabric enclosure.

FIGS. 5-8 show one method of manufacturing an underwire assembly 100 for attachment to other components of a brassiere, the underwire assembly 100 including a fabric layer 110 and an underwire 120. FIG. 5 is a perspective view of a partially formed fabric enclosure 140 showing the beginning of a sealed side 150 of the fabric enclosure 140. The fabric enclosure 140 is preferably created by bringing together opposite side ends 141, 143 of fabric layer 110 and fastening the opposite side ends 141, 143 to one another substantially along a length thereof. The fabric enclosure 140 includes a side 154 opposite sealed side 150. Fabric enclosure 140 further includes first and second end portions 142, 144 having first and second open ends 145, 147 respectively. Side 154 is preferably the folded over portion of fabric layer 100. In order to keep underwire 120 within a desired channel 155 along the length of fabric enclosure 140, the folded over portion of fabric layer 100 may be fastened by stitching, adhesive, or other fastening means as shown in FIG. 7.

Figure 8:
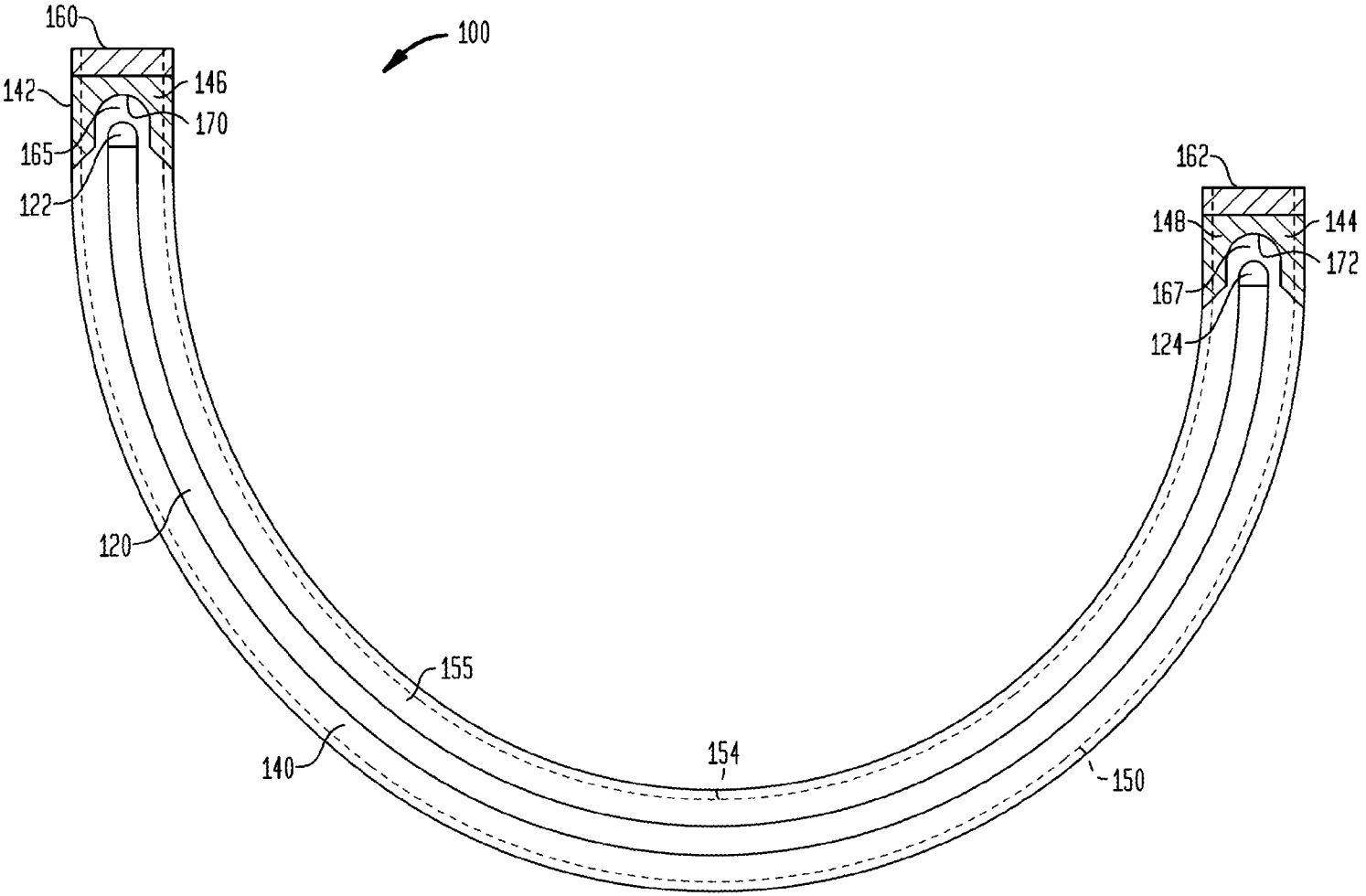
FIG. 8 is a cross-sectional front view of one embodiment of an underwire assembly of the present invention shown an underwire completely housed within a fabric enclosure.

FIG. 6 is a perspective view of an underwire 120 just before being received by an open end 147 of fabric enclosure 140. Preferably, underwire 120 is inserted into first open end 147 of fabric enclosure 140 and continues to pass through fabric enclosure 140 as shown in FIG. 7 until a first end 122 and a second end 124 of the underwire 120 are completely housed within the fabric enclosure 140 as shown in FIG. 8. First and second open ends 145, 147 of the fabric enclosure 140 such that the underwire 120 is encased within side 154, sealed side 150 and first and second sealed ends 146, 148 of the fabric enclosure 140.

As further shown in FIG. 8, opposite side ends 141, 143 of fabric layer 140 created sealed side end 150 are fastened together by stitching. Alternatively, opposite side ends 141, 143 of fabric layer 140 may be fastened together by adhesive or by ultrasonic welding or other fastening means, for example.

Sealing first and second open ends 145, 147 of fabric enclosure 140 creates first and second extension ends 160, 162 extending outwardly from the first and second sealed ends 146, 148 of the fabric enclosure 140 respectively. Sealing the first and second open ends 145, 147 of the fabric enclosure 140 seals an inner surface of the fabric layer 100, now enclosure 140, substantially around the first and second ends 122, 124 of the underwire 120. In sealing the first open end 145 of the fabric enclosure 140, a first space 165 is created between the first end 122 of the underwire 120 and the sealed first end 146 of the fabric enclosure 140. In sealing the second open end 147 of the fabric enclosure 140, a second space 167 is created between the second end 124 of the underwire 120 and the sealed second end 148 of the fabric enclosure 140.

First and second spaces 165, 167 are small gaps left between the ends 122, 124 of the underwire 120 and the sealed ends 146, 148 to account for longitudinal shrinkage of the fabric enclosure 140 during sealing of sealed ends 146, 148. Based on specifications of the brassiere, the shape, size, and area of first and second spaces 165, 167 may be altered. Sealed ends 146, 148 may be sealed by an adhesive, by ultrasonic welding, by RF welding, or other similar means. Sealing the ends in this manner preferably ensures that the sealed ends 146, 148 are smooth due to the low profile as compared to using a folded fabric and a bar-tack sewing stitch.

Figure 9:
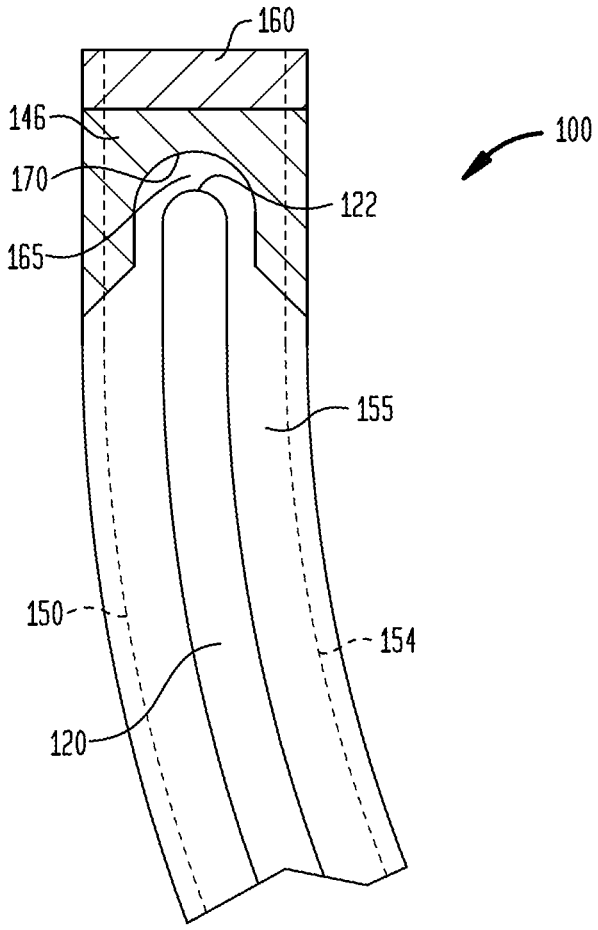
FIG. 9 is a cross-sectional front view of a portion of the underwire assembly shown in FIG. 8 having a sealed end around an end of an underwire.

The shape of inner perimeter 170, 172 of sealed ends 146, 148 respectively, adjacent first and second ends 122, 124 of underwire 120, is preferably determined by the fastening means used to seal sealed ends 146, 148. As shown in FIGS. 8 and 9, inner perimeter 170, 172 of sealed ends 146, 148 is located around the entire perimeter of first and second ends 122, 124 of underwire 120. Such a shape of inner perimeter 170, 172 preferably keeps the ends 122, 124 of the underwire 120 in a specifically confined area.

Figure 10:
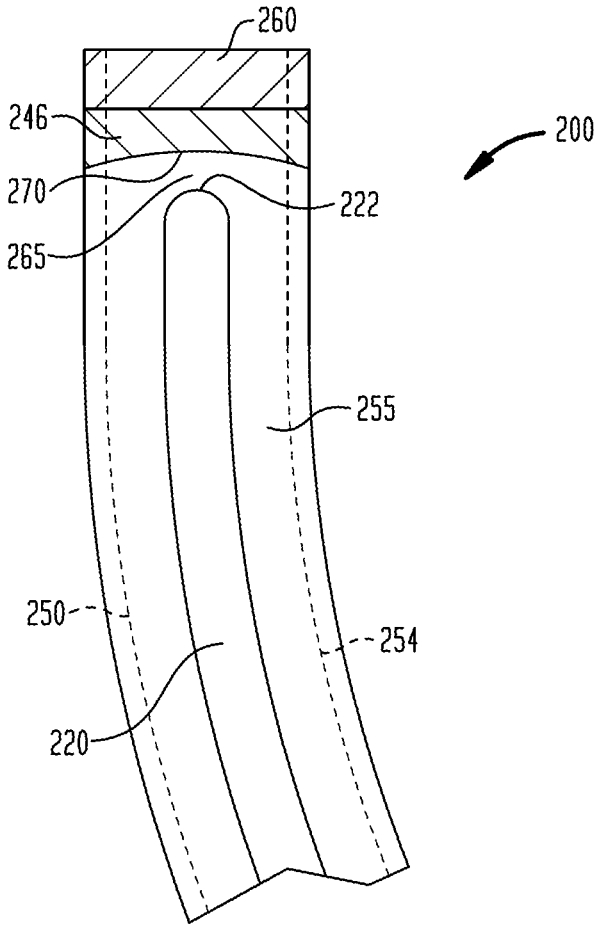
FIG. 10 is a cross-sectional front view of a portion of another embodiment of an underwire assembly of the present invention having a curved sealed end adjacent an end of an underwire.
Figure 11:
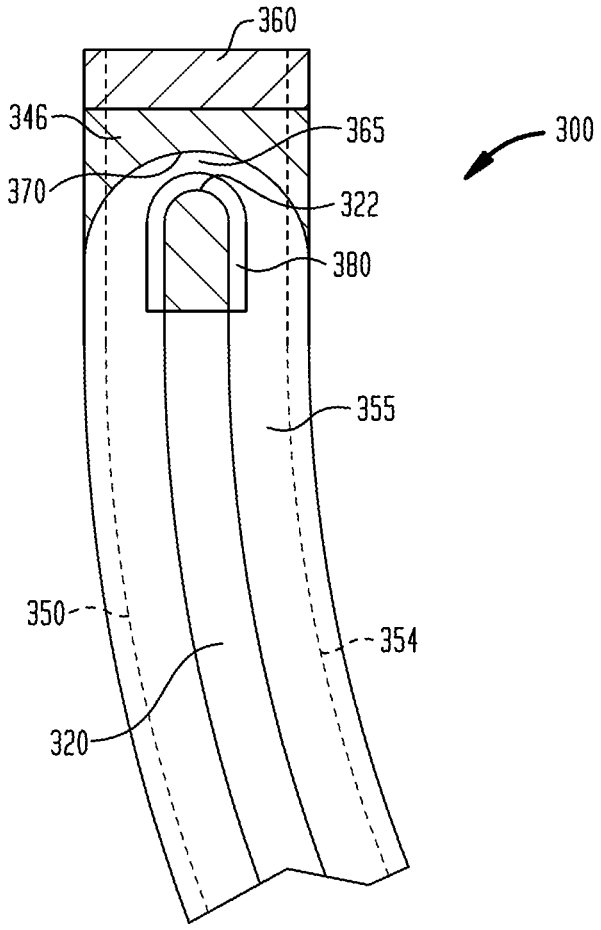
FIG. 11 is a cross-sectional front view of a portion of another embodiment of an underwire assembly of the present invention having an alternative curved sealed end adjacent an end of an underwire.

FIGS. 10-11 show alternative shapes for inner perimeters of sealed ends of a fabric enclosure. FIG. 10 is a cross-sectional front view of a portion of an underwire assembly 200 having a sealed end 246 adjacent an end 222 of an underwire 220. Inner perimeter 270 of sealed end 246 is curved and is not located around the entire perimeter of first end 222 of underwire 220. A space 265 is formed between inner surface 270 and first end 222 of underwire 220.

FIG. 11 is a cross-sectional front view of a portion of another embodiment of an underwire assembly 300 of the present invention having a sealed end 346 adjacent an end 322 of an underwire 320. Inner perimeter 370 of sealed end 346 has an alternative curvature from the curvature of inner surface 270 shown in FIG. 10. First end 322 of underwire 320 has a covered tip 380 that aids in keeping first end 322 from piercing fabric enclosure 340. A space 365 is formed between inner surface 370 and first end 322 of underwire 320.

Figure 12:
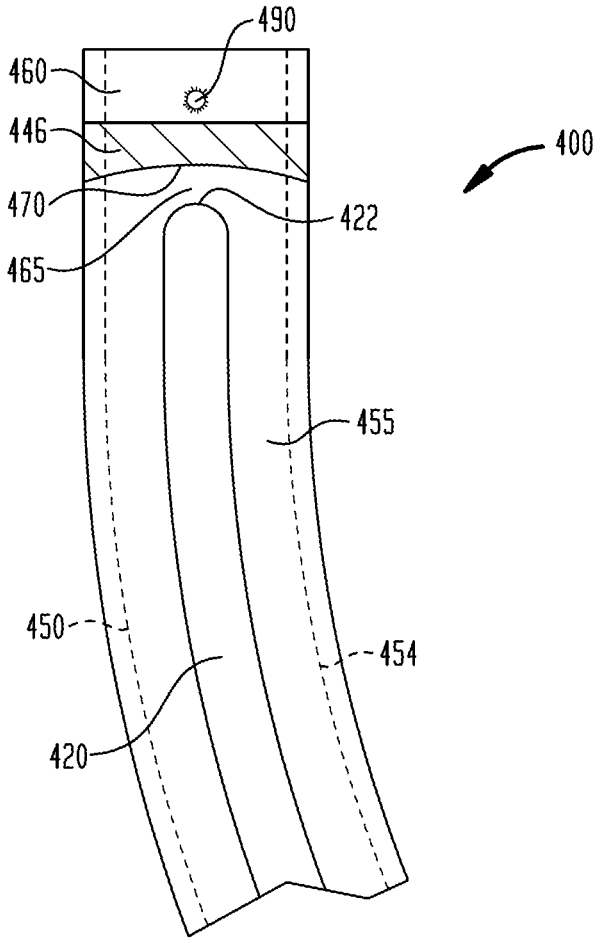
FIG. 12 is a partial cross-sectional front view of a portion of another embodiment of an underwire assembly of the present invention having an identification marker located on a sealed end of a fabric enclosure.

FIG. 12 is a cross-sectional front view of a portion of another embodiment of an underwire assembly 400 of the present invention having an identification marker 490 located on a sealed extension end 460 of a fabric enclosure 440. Identification marker 490 can be used to signify the end of fabric enclosure 440 and which of ends 422, 424 of underwire 420 should be inserted into open ends 445, 447 (not shown) of fabric enclosure 440.

The method of manufacturing an underwire assembly 100 for attachment to other components of a brassiere, preferably further includes attaching the side 154 of the fabric enclosure 140 opposite the sealed side 150 substantially along a length of the side 154 to a first portion of the brassiere in order to secure the fabric enclosure 140 to the brassiere with the sealed side 150 facing away from side 154 being attached to the brassiere. Preferably, first extension end 160 is attached to a second portion of the brassiere and second extension end 162 to a third portion of the brassiere to further secure the underwire assembly 100 to the brassiere. Underwire assemblies 200, 300, and 400 can be attached to a brassiere in a similar manner as described above with respect to underwire assembly 100.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method of manufacturing an encased underwire assembly for attachment to an article of clothing, comprising:

creating a fabric enclosure by bringing together opposite side edges of a fabric layer and fastening the opposite side edges to one another substantially along a length thereof;

inserting an underwire into a first open end of the fabric enclosure and continuing to pass the underwire through the fabric enclosure until a first end and a second end of the underwire are housed within the fabric enclosure, an outer convex surface of the underwire located adjacent the fastened opposite side edges; and sealing the first open end and a second open end of the fabric enclosure, wherein sealing the first and second open ends of the fabric enclosure creates first and second sealed ends and first and second extension ends extending outwardly from the first and second sealed ends of the fabric enclosure respectively.

2. The method of claim 1, wherein the opposite side edges of the fabric layer are fastened together by stitching.

3. The method of claim 1, wherein the opposite side edges of the fabric layer are fastened together by adhesive.

4. The method of claim 1, wherein the opposite side edges of the fabric layer are fastened together by ultrasonic welding.

5. The method of claim 1, further including attaching the first extension end to a first portion of the article of clothing and the second extension end to a second portion of the article of clothing to secure the underwire assembly to the article of clothing.

6. The method of claim 5, wherein the first extension end is attached to the first portion of the article of clothing and the second extension end is attached to the second portion of the article of clothing by at least one member of a group consisting of adhesive, stitching and ultrasonic welding.

7. The method of claim 1, wherein sealing the first and second open ends of the fabric enclosure seals the fabric layer substantially around the first and second ends of the underwire.

8. The method of claim 1, wherein sealing the first open end of the fabric enclosure creates a first space between the first end of the underwire and the sealed first end of the fabric enclosure and a second space between the second end of the underwire and the sealed second end of the fabric enclosure.

9. A method of manufacturing an encased underwire assembly for attachment to an article of clothing, comprising:

creating a fabric enclosure around an underwire by bringing together opposite side edges of a fabric layer and fastening the opposite side edges to one another substantially along a length thereof such that a first end and a second end of the underwire are housed within the fabric enclosure and an outer convex surface of the underwire is located adjacent the fastened opposite side edges; and sealing a first open end of the fabric enclosure adjacent the first end of the underwire and a second open end of the fabric enclosure adjacent the second end of the underwire of the fabric enclosure, wherein sealing the first and second open ends of the fabric enclosure creates first and second sealed ends and first and second extension ends extending outwardly from the first and second sealed ends of the fabric enclosure respectively.

10. The method of claim 9, wherein the opposite side edges of the fabric layer are fastened together by stitching.

11. The method of claim 9, wherein the opposite side edges of the fabric layer are fastened together by adhesive.

12. The method of claim 9, wherein the opposite side edges of the fabric layer are fastened together by ultrasonic welding that activates bonding capability of the fabric layer.

13. The method of claim 9, further including attaching the first extension end to a first portion of the article of clothing and the second extension end to a second portion of the article of clothing to secure the underwire assembly to the article of clothing.

14. The method of claim 9, wherein sealing the first and second open ends of the fabric enclosure seals the inner fabric layer substantially around the first and second ends of the underwire.

15. The method of claim 9, wherein sealing the first open end of the fabric enclosure creates a first space between the first end of the underwire and the sealed first end of the fabric enclosure and a second space between the second end of the underwire and the sealed second end of the fabric enclosure.

16. An encased underwire assembly for attachment to an article of clothing comprising:

an underwire having an inner radius, an outer radius, a first end and a second end; and a fabric enclosure having a first fastened side including fastened opposite side edges of a fabric layer located adjacent the outer radius of the underwire substantially along a length of the fabric enclosure, a first sealed end adjacent the first end of the underwire and a second sealed end adjacent the second end of the underwire;

a first fabric extension extending outwardly from the first sealed end of the fabric enclosure; and a second fabric extension extending outwardly from the second sealed end of the fabric enclosure.

17. The encased underwire assembly of claim 16, wherein the opposite side edges of the fabric layer is fastened with adhesive.

18. The encased underwire assembly of claim 16, wherein the first fabric extension is configured to be attached to a first portion of the article of clothing and the second fabric extension is configured to be attached to a second portion of the article of clothing to secure the underwire assembly to the article of clothing.

* * * * *